United States Patent [19]

Geisow

[11] 4,390,171

[45] Jun. 28, 1983

[54] COMPRESSION SPRING CAPSULE

[75] Inventor: Bernard H. Geisow, Houston, Tex.

[73] Assignee: Daniel Industries, Inc., Houston, Tex.

[21] Appl. No.: 315,710

[22] Filed: Oct. 28, 1981

Related U.S. Application Data

[62] Division of Ser. No. 963,459, Nov. 24, 1978, Pat. No. 4,331,315.

[51] Int. Cl.[3] ..... F16F 3/04

[52] U.S. Cl. ..... 267/169; 248/623; 267/91; 267/103; 267/170

[58] Field of Search ..... 267/60, 615, 169, 170, 267/174, 178, 179, 168, 175, 176, 177, 70, 4, 91, 92, 95, 103; 248/573, 623

[56] References Cited

U.S. PATENT DOCUMENTS

| | | | |
|---|---|---|---|
| 165,647 | 7/1875 | Wootten | 267/4 |
| 336,543 | 2/1886 | Banister | 267/60 |
| 1,696,797 | 12/1928 | Fornaca | 267/169 X |
| 2,439,484 | 4/1948 | Miner | 267/4 X |
| 2,518,387 | 8/1950 | Shaw | 267/169 X |
| 3,509,913 | 5/1970 | Lewis | 166/321 X |
| 3,891,823 | 6/1975 | Dulude et al. | 267/179 X |

FOREIGN PATENT DOCUMENTS

| | | | |
|---|---|---|---|
| 74221 | 5/1952 | Denmark | 267/170 |
| 57827 | 9/1934 | Norway | 267/179 |

*Primary Examiner*—George E. A. Halvosa
*Attorney, Agent, or Firm*—Gunn, Lee & Jackson

[57] ABSTRACT

A compression spring capsule is provided for tubular valve actuating members and incorporates a plurality of helical compression springs arranged in circular relation. Opposed generally cylindrical spring retainers each being receivable in a cylindrical receptacle form opposed receptacles receiving opposed ends of the springs. Spring guide rods are disposed within each of the helical springs with the ends thereof received within the opposed receptacles of the spring retainers.

3 Claims, 18 Drawing Figures

FIG. 3
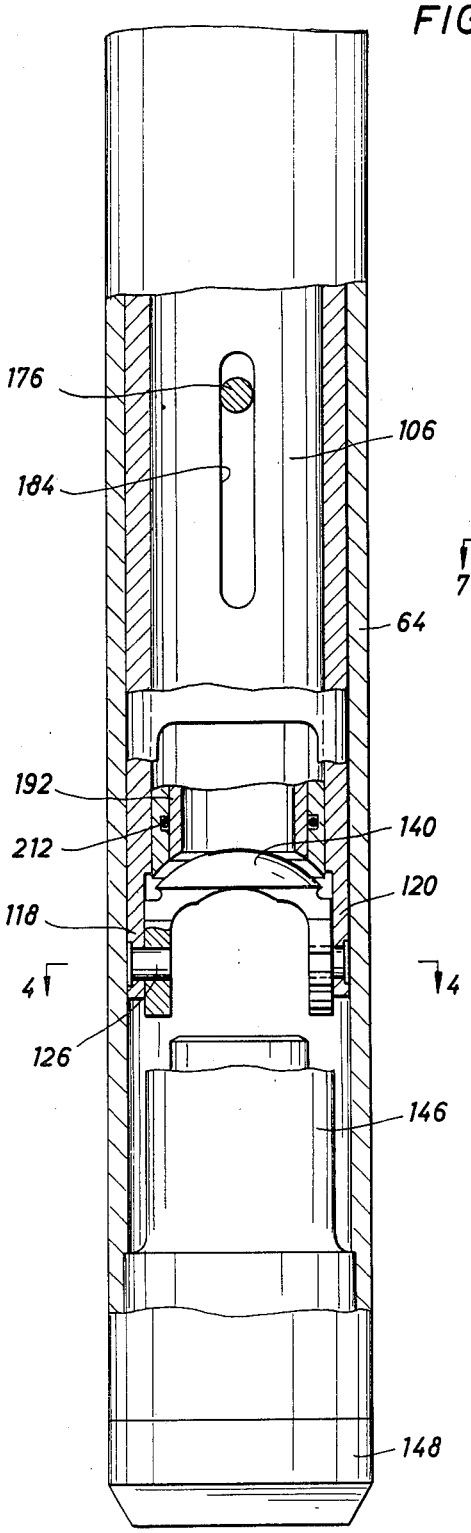
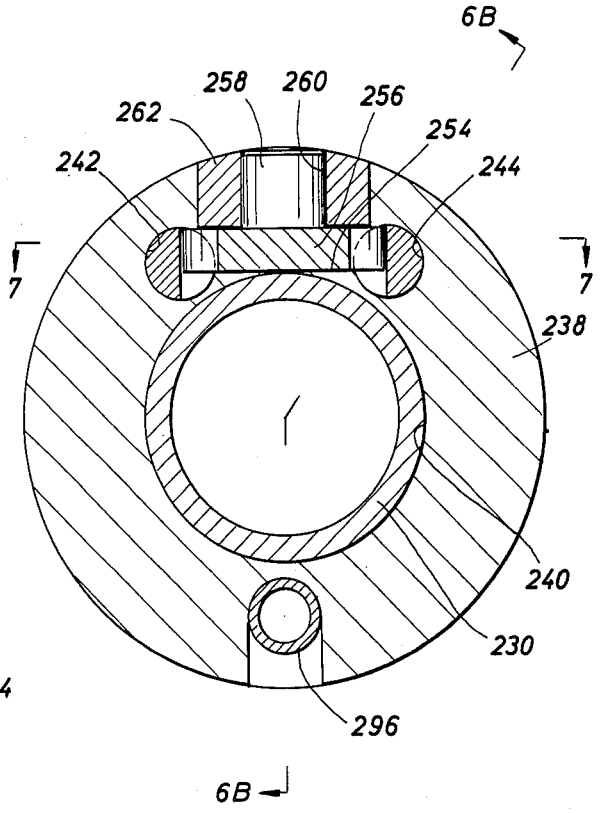
FIG. 8

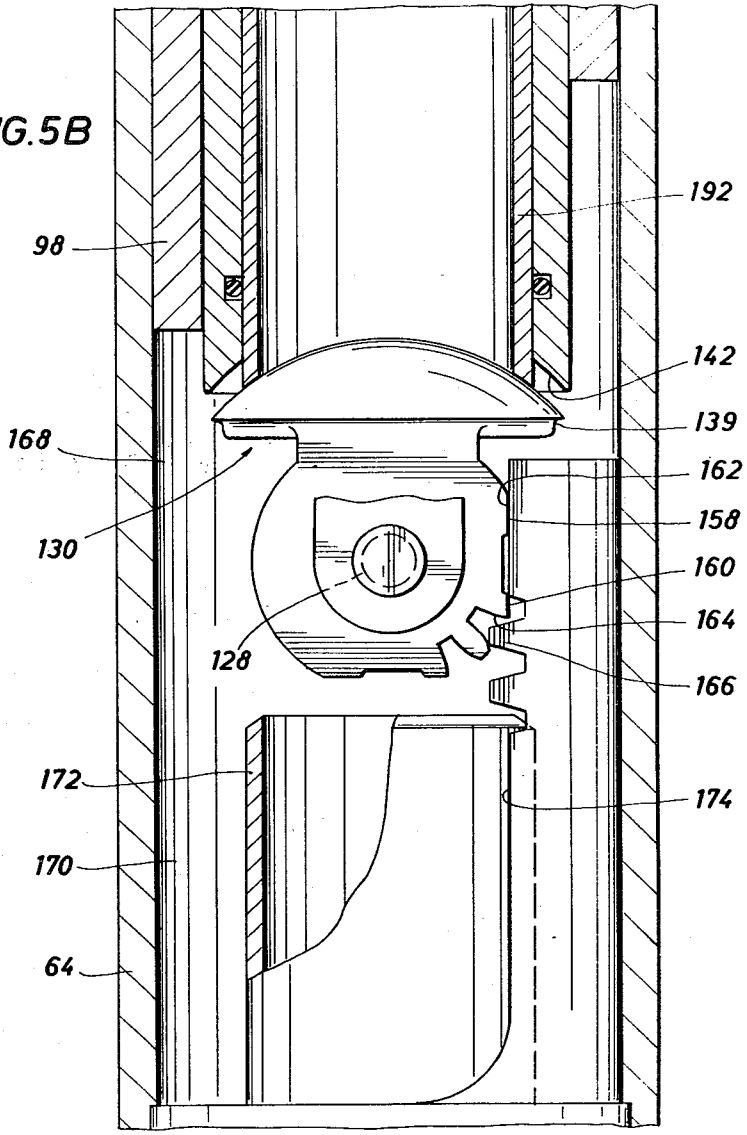
FIG. 5B
FIG. 5A
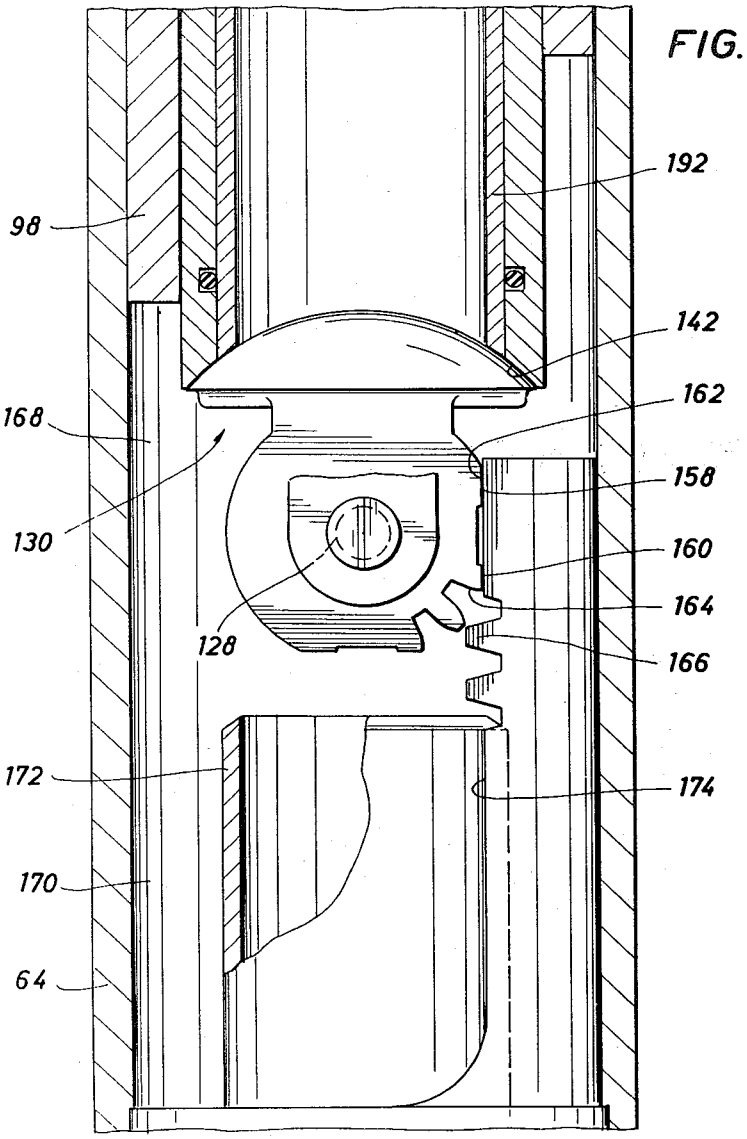

COMPRESSION SPRING CAPSULE

This is a division of application Ser. No. 963,459, filed Nov. 24, 1978, now U.S. Pat. No. 4,331,315.

FIELD OF THE INVENTION

This invention relates generally to pressure sensitive and velocity sensitive safety valves for controlling the flow in well production and other flowlines in the event an unsafe flow condition is sensed. More particularly, the invention also relates to safety valve mechanisms that are controllably actuatable for purposes of selective flow control and are automatically actuatable as a storm choke or safety valve responsive to sensing a predetermined fluid flow condition at the valve. Even more particularly, the valve mechanism relates to a valve apparatus defining a straight through unobstructed flow passage that allows objects to be passed therethrough in the open condition of the valve.

The term "storm choke" is typically utilized in the well completion and production industry where deep wells are completed for the purpose of producing petroleum products, such as gas, oil, etc. A storm choke is typically located in a production tubing string within a well for the purpose of automatically shutting off production from the well when conditions arise that are potentially hazardous to the operation and safety of the well or when the operator of the well desires to cease production through closure of a valve located within the well itself. For example, in the event a flowline should rupture at the wellhead or immediately downstream thereof, it is desirable to provide means for insuring that production is shut in as rapidly as possible. Obviously, certain abnormal flow conditions which occur, such as by rupture of a flowline or the like, develop a potentially hazardous condition to personnel and equipment. In cases where petroleum products are being produced, a potential fire hazard exists when a flowline rupture occurs, especially in land based well operations. Where production of petroleum products is accomplished in an offshore or marine environment, the additional hazards of this environment due to wave action, debris, moving equipment, etc. makes the provision of storm chokes in wells even more necessary. It is desirable that production of petroleum products be allowed to continue even though the wells may be left unattended for long periods of time and even though a potentially dangerous condition, such as a storm, for example, might exist. In the event, however, the flowlines or other fluid production components of the well should become damaged to the extent that leakage occurs, this leakage is automatically sensed and results in automatic shutin of the well by virtue of the storm choke. It is desirable that a well, thus shut in, will remain out of production until such time as repairs are made. Properly functioning storm choke systems will prevent undesirable loss of production fluid will protect the environment against pollution by petroleum products and protect other equipment from being damaged or destroyed such as might otherwise occur if a damaged well production facility should flow in uninterrupted manner for an extended period of time.

Often, it is necessary or desirable to shut off a well for maintenance work at the wellhead or for other reasons. Hence, it is desirable that the well may be readily placed back in production after operation of the storm choke without the necessity of killing the well with fluids followed by swabbing, back-circulation, or other well completion procedures.

It is desirable that a storm choke be capable of being used with conventional well completion methods and wellhead equipment. The storm choke can also be dimensionally suitable for installation in standard casing sizes employed in wells and still provide full opening ports which will offer no restrictions preventing the running of instruments or other tools through the device. The ports through which production fluid from the well flows should be sufficiently large in dimension to minimize cutting by sand that might be carried with the production fluid.

In many cases, down hole production control devices such as storm chokes are subjected to a highly erosive and/or corrosive environment, depending upon the nature of the production fluid. In many cases it is desirable to periodically remove such apparatus from the well for repair or replacement, thereby insuring that the apparatus is always maintained in serviceable condition. In order to limit the expense involved in such repair and replacement operations, it is desirable to connect storm choke apparatus to wire line tool systems so that it will not be necessary to remove an entire production tubing string from the well in order to change out a storm choke. Moreover, in multiple completion systems, it may be desirable to cease production from a particular well zone while production is allowed to continue from different production formations. It may be desirable therefore to provide independent tubing strings for producing different production zones with a storm choke system being provided for each of the tubing strings. The storm chokes can be installed and retrieved by means of wire line systems thereby simplifying repair operations and maintaining repair costs at an acceptably low level.

In most cases, storm chokes and other down hole valve equipment define a rather circuitous flow path for the production fluid medium. Also, in some cases it is desirable to run well servicing tools through the valve mechanism in order to achieve down hole servicing operations. In such cases it is desirable to provide a valve mechanism having a straight through flow passage and yet being capable of closing in response to sensing an abnormal flow condition requiring automatic valve shutoff.

In many cases, storm chokes remain open responsive to forces developed by a compression spring and, when the force of the spring is overcome by the abnormal flow position, the valve mechanism will be moved to its closed position and it will remain closed until such time as pressure is supplied through the tubing string from the wellhead. It is desirable to provide a valve mechanism that functions automatically responsive to sensing an abnormal flow condition to shut off production flow through the tubing string and yet provide effective control of the valve mechanism by appropriate manipulation of surface control equipment. Further, it is desirable to provide a valve mechanism that is capable of mechanical closure in the event the automatic control mechanism of the valve should be inoperative for any reason, thus providing a mechanism back up for automatic closure of the storm choke.

Most storm choke type valve mechanisms incorporate a valve element such as a ball valve, check valve, etc. which is exposed to the flowing production fluid medium. Since the production fluid will typically contain quantities of particulate, such as sand and other debris, such valve mechanisms can easily become eroded or fouled to such extent that proper operation of the valve mechanism is not possible. It is desirable to provide a storm choke type valve mechanism incorporating a valve element that is completely shielded from the flowing production fluid during operation.

In cases where valve leakage is not allowed, it is desirable to provide a valve mechanism incorporating a valve element, which valve mechanism is not in any way exposed to the environment outside of the valve body. In cases where leaked fluid may be hazardous to the environment, or hazardous from the standpoint of fire, etc., it may be desirable to provide a valve body structure that completely encloses the valve mechanism and precludes any leakage whatever exteriorly of the flowline.

THE PRIOR ART

Subsurface safety valves, commonly referred to as storm chokes, are quite well known in the well production industry, having been employed for many years in pressurized petroleum well systems. In some cases, the storm choke is located in the wellhead structure, as shown by U.S. Pat. No. 3,724,501, and, in other cases, storm chokes are located within a tubing string as shown by U.S. Pat. Nos. 3,799,192 and 2,785,755. In some cases, storm chokes are located at the lower extremity of a string of production tubing as shown by U.S. Pat. No. 3,035,808. Subsurface safety valves have also been developed that function solely in response to conditions sensed within the well, as in U.S. Pat. No. 3,757,816, while other subsurface valve mechanisms are controllable from the surface as well as being responsive to abnormal well conditions, as in U.S. Pat. No. 4,069,871.

SUMMARY OF THE INVENTION

With the foregoing in mind, it is a primary feature of the present invention to provide a novel valve mechanism that may be efficiently utilized as a down hole valve mechanism or storm choke or may conveniently take the form of an inline safety valve for general flowline use.

It is also a feature of the present invention to provide a novel valve mechanism incorporating a valve element having both linear and rotary components of movement within a valve body to allow direct seating and unseating movement and to allow the valve element to be freely rotated between the open and closed positions thereof.

It is an even further feature of the present invention to provide a novel valve mechanism incorporating a pivotal valve element that may be pivotally moved out of the flowstream to allow uninterrupted flow of fluid in the open position thereof and to further allow passage of tools and other devices through the valve mechanism as desired.

Among the several objects of the present invention is noted the contemplation of a novel valve mechanism incorporating a valve element that is retractable or positionable within a protective enclosure and is protected against contact with the flowing fluid during operation of the valve.

It is an even further feature of the present invention to provide a novel valve mechanism that functions efficiently as a safety valve responsive to sensing abnormal flow conditions and also functions as a controllable valve to achieve controlled operation as desired.

An important feature of the present invention includes the provision of means for imparting mechanical movement to the valve mechanism, thus insuring positive closure of the same in the event the valve mechanism does not respond properly to the sensing of an abnormal flow condition.

It is an even further feature of the present invention to provide a novel valve mechanism that may be installed and removed by wire line equipment, thus precluding any necessity for removing a tubing string in order to achieve servicing of the valve mechanism.

Another important feature of this invention concerns the provision of a flow line control valve that prohibits any possibility of leakage to the environment surrounding the valve and which may be controlled from a remote location.

It is also a feature of the present invention to provide a novel valve mechanism that functions as a controllable surface flowline valve providing absolute protection against leakage and which valve also functions as a safety valve responsive to the sensing of an abnormal flow condition.

SUMMARY OF THE INVENTION

These and other features of the present invention are attained in accordance with the concept of the present invention through the provision of a valve mechanism incorporating a valve body that is connectable to a flowline or tubing string in any desired manner. A valve element is movably positioned within a valve chamber defined within the valve body and is movable with both rotary and linear components of movement so as to be linearly movable into and away from seated engagement with a valve seat and is pivotally movable from a position within the flow passage to a protected, retracted position within a protective receptacle also defined within the valve body. Actuation of the valve element between its open and closed positions is accomplished by means of an elongated sleeve type piston actuator element that cooperates with the valve element to define a rack and pinion gear type valve actuating system, with the clam-shell pinion element being movable by the piston sleeve element and the pinion gear accomplishing rotation of the valve element responsive to linear movement of the piston sleeve.

Within the valve mechanism may be provided a compressing spring that is adapted to maintain the valve mechanism in the closed position thereof in absence of an opposing force supplied in the form of hydraulic fluid introduced into the piston chamber and acting upon one extremity of the piston element. For down hole application, closure of the valve mechanism is also enhanced by formation pressure or line pressure that acts upon the opposite extremity of the sleeve piston element and enhances the force developed by the closure spring.

For application of the invention in a flow line control valve, a hydraulically energized piston may be positively actuated for opening and closing movements responsive to hydraulic fluid supplied from a remote power and control system.

Other and further objects, advantages and features of the present invention will become apparent to one skilled in the art upon consideration of this entire disclosure, including this specification and the annexed drawings. The form of the invention, which will now be described in detail, illustrates the general principles of the invention, but it is to be understood that this detailed description is not to be taken as limiting the scope of the present invention.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings, which drawings form a part of this specification.

It is to be noted, however, that the appended drawings illustrate only typical embodiments of the invention and are, therefore, not to be considered limiting of its scope, for the invention may admit to other equally effective embodiments.

In the Drawings:

Figure 1:
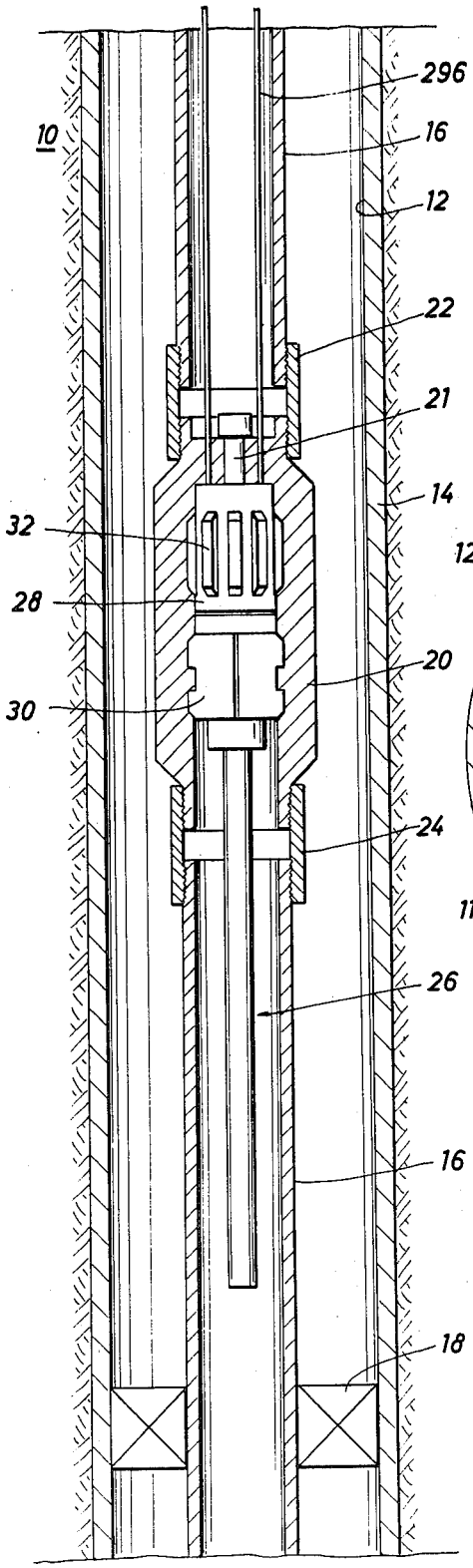

The present invention, both as to its organization and manner of operation, together with further objects and advantages thereof may best be understood by way of illustration and example of certain embodiments when taken in conjunction with the accompanying drawings in which:

FIG. 1 is a pictorial representation, partly in section, illustrating a storm choke type down hole safety valve mechanism installed within a well by means of a wire line retrieval mechanism.

Figure 2A:
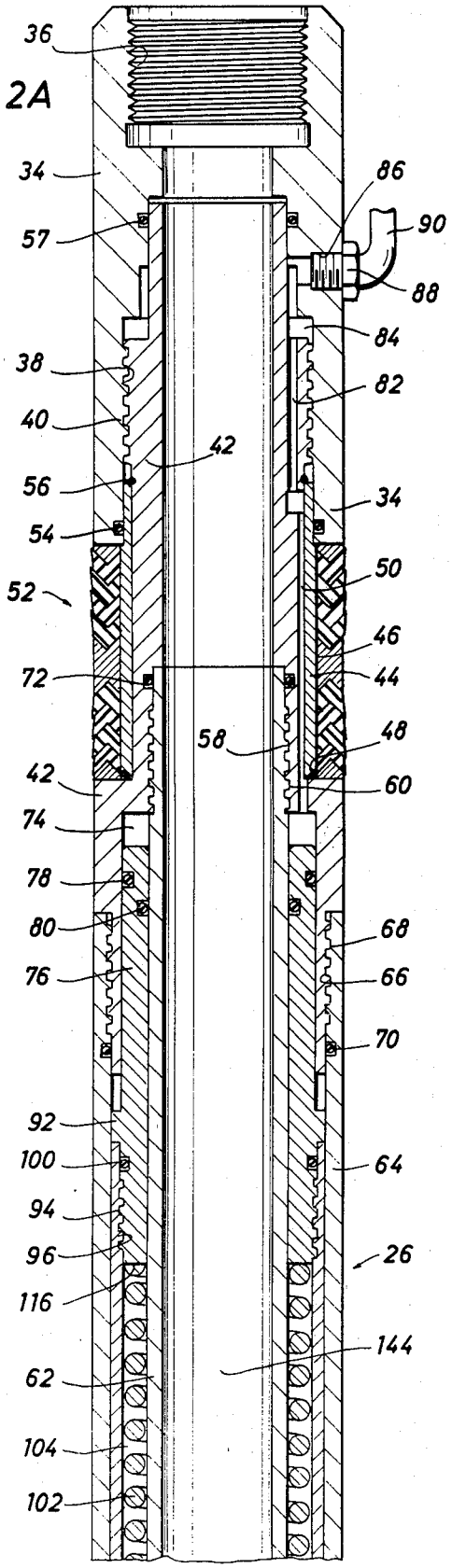

FIG. 2A is a sectional view of the upper section of a down hole type safety valve or storm choke constructed in accordance with the present invention and showing the valve mechanism in registered but unseated relation with the valve seat.

Figure 2B:
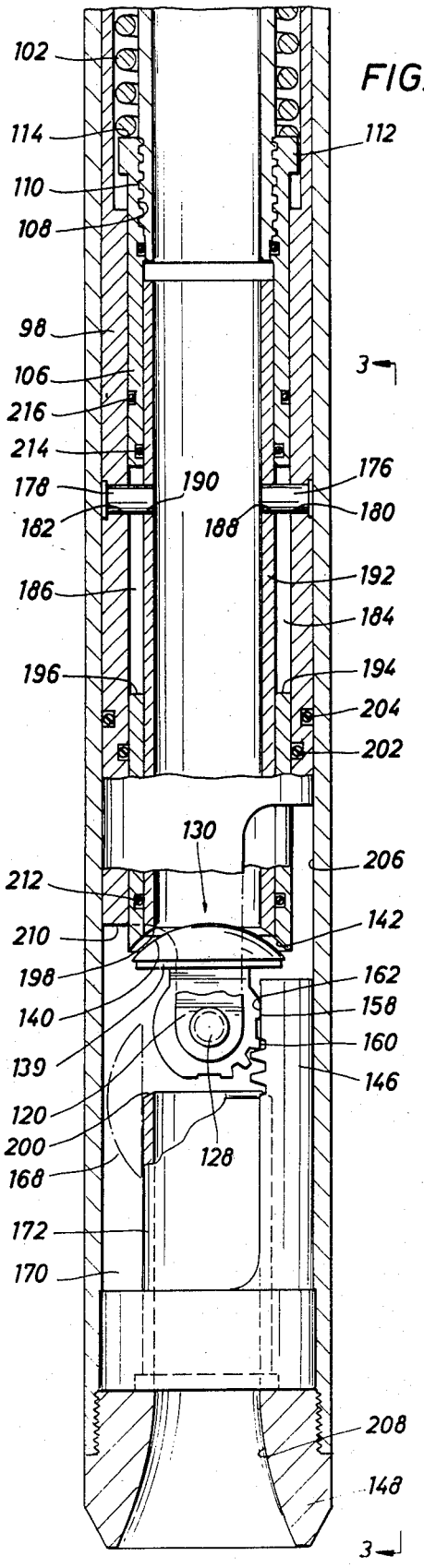

FIG. 2B is a sectional view of the lower portion of the down hole valve mechanism of FIG. 2A.

FIG. 3 is a fragmentary sectional view of the valve mechanism of FIGS. 2A and 2B taken along line 3—3 of FIG. 2B.

Figure 4:
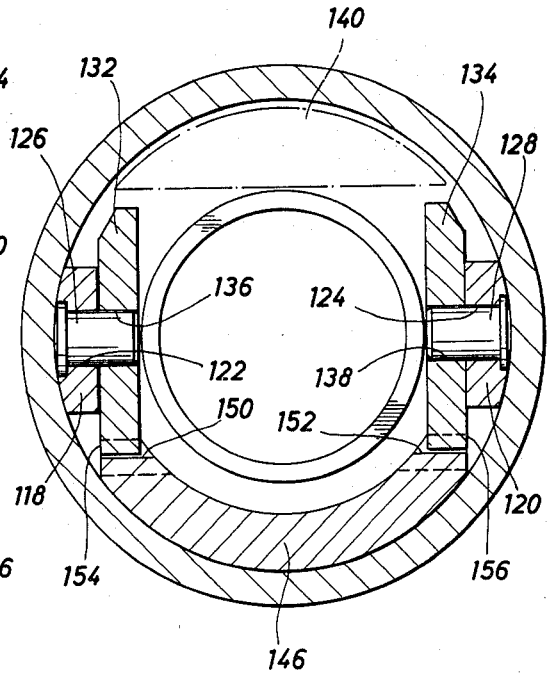

FIG. 4 is a sectional view of the valve mechanism taken along line 4—4 of FIG. 3 and illustrating the valve element as being rotated 90° and being out of blocking relation with the flow passage of the valve.

FIG. 5A is a partial sectional view of the safety valve mechanism illustrated in FIG. 2 and illustrating the valve element in its fully closed position.

FIG. 5B is a partial sectional view of the valve mechanism illustrated in FIG. 2 with the valve element being linearly retracted from the valve seat and being positioned for 90° rotation.

Figure 5D:
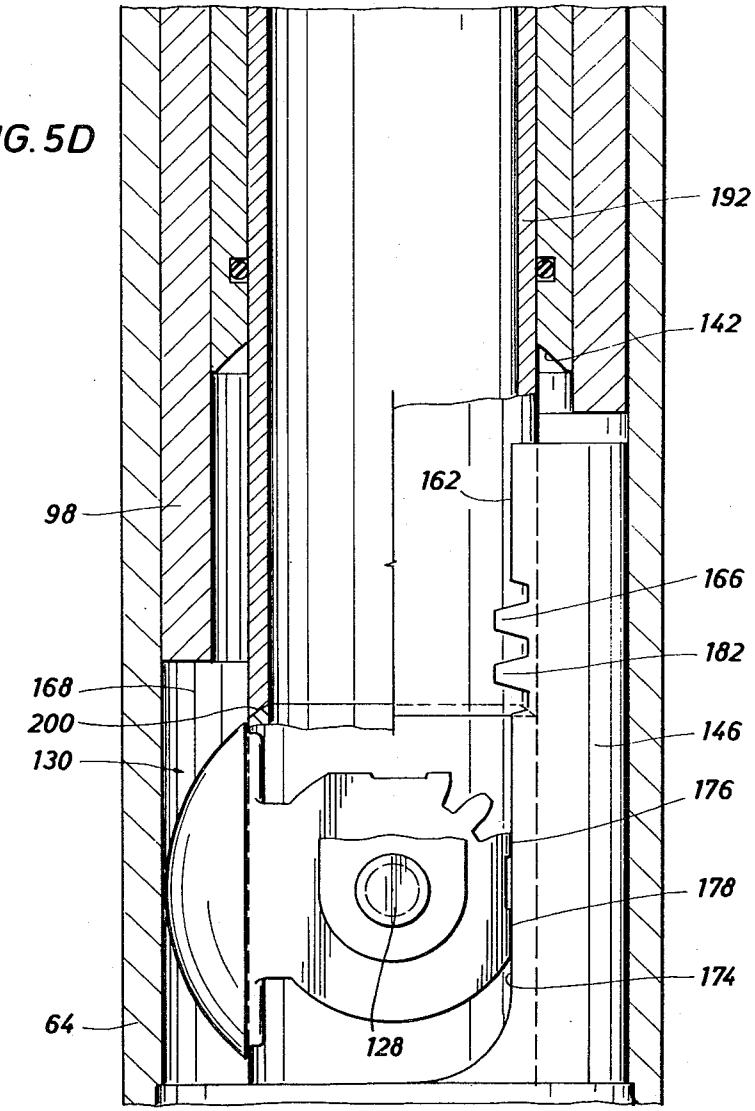
Figure 5C:
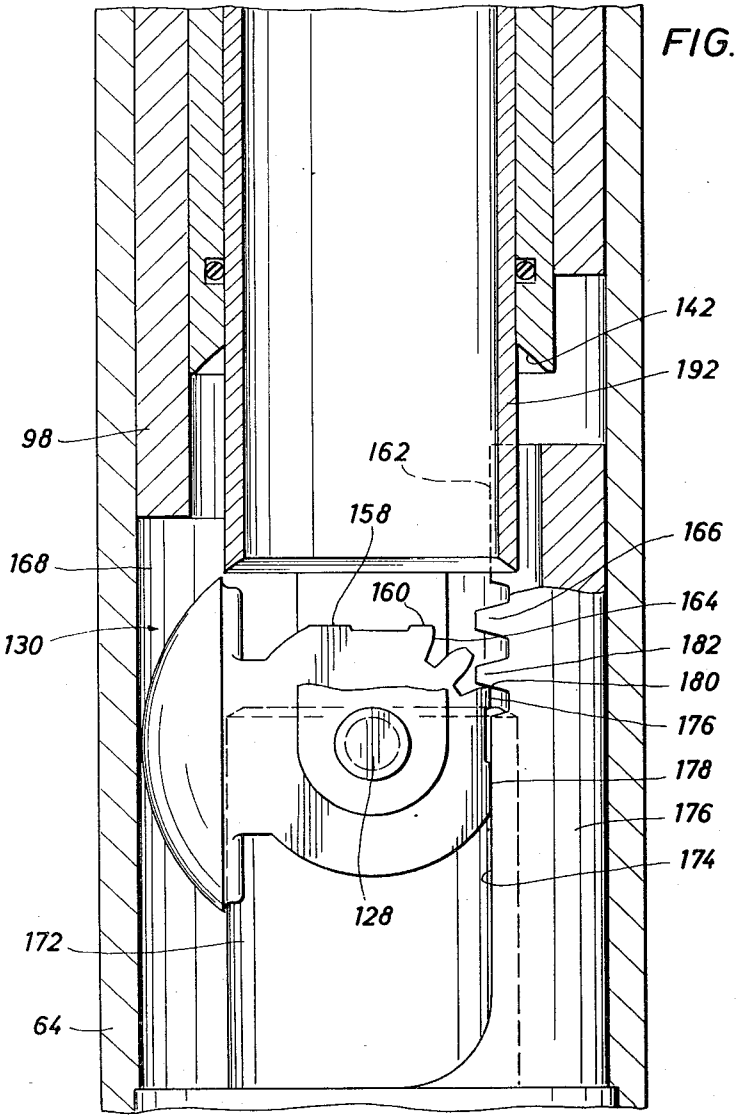

FIG. 5C is a partial sectional view of the valve mechanism of FIG. 2 illustrating the valve element at the end of its 90° rotational movement.

FIG. 5D is also a partial sectional view of the valve mechanism of FIG. 2 illustrating the valve element in its fully retracted position within the protective receptacle and showing the masking tube in its fully seated position, thus isolating the valve element from the path of the flowing fluid through the valve mechanism.

Figure 6A:
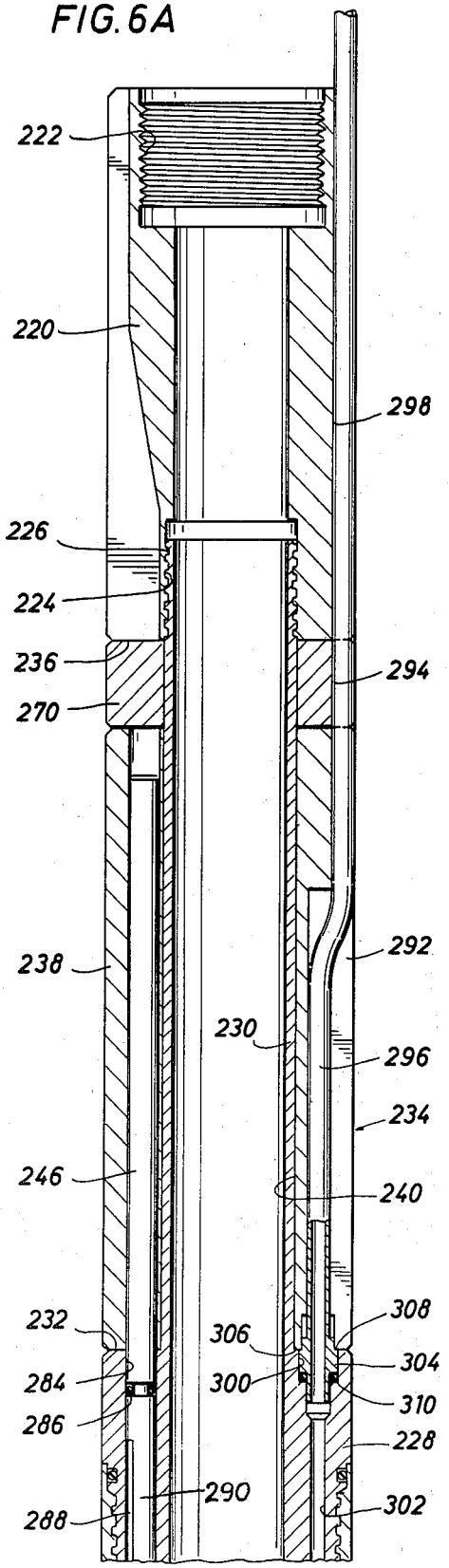

FIG. 6A is a partial sectional view of an alternative embodiment illustrating a down hole type safety valve mechanism constructed in accordance with this invention and being arranged for both hydraulic and mechanical actuation as well as mechanical and pressure actuation toward the closed position thereof.

Figure 6B:
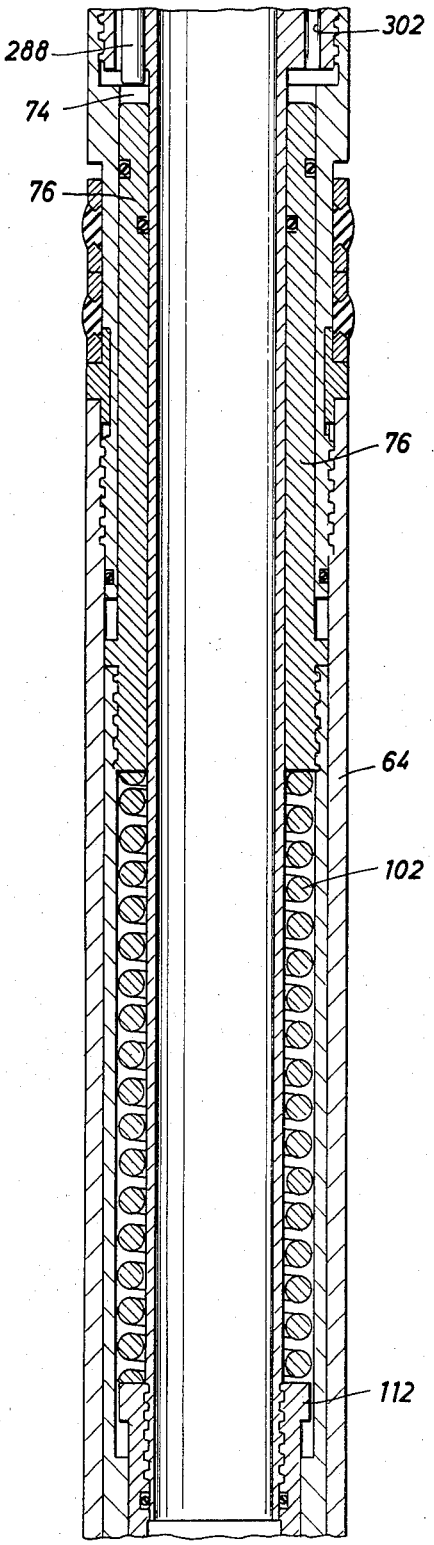

FIG. 6B is a partial sectional view of an intermediate portion of the valve mechanism of FIG. 5A and illustrating the mechanical and hydraulic actuation features in detail.

Figure 7:
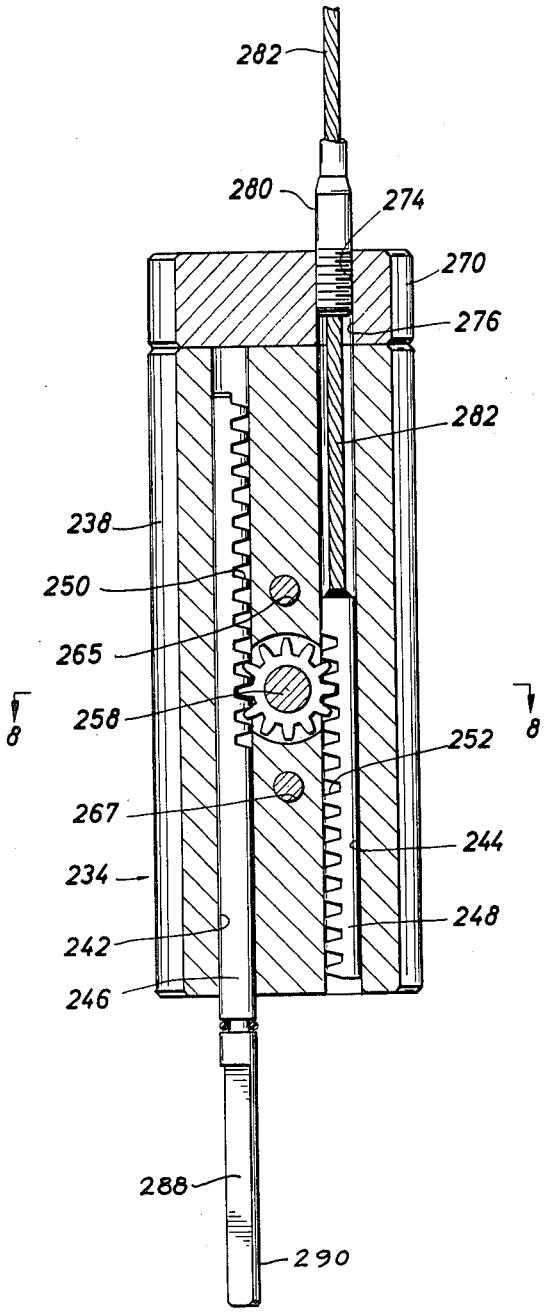

FIG. 7 is a partial sectional view of a mechanical actuator device that may be manipulated to maintain the valve in an open condition as desired.

FIG. 8 is a transverse sectional view of the mechanical actuator mechanism illustrated in FIG. 7 and taken along line 8—8 of FIG. 7.

Figure 9:
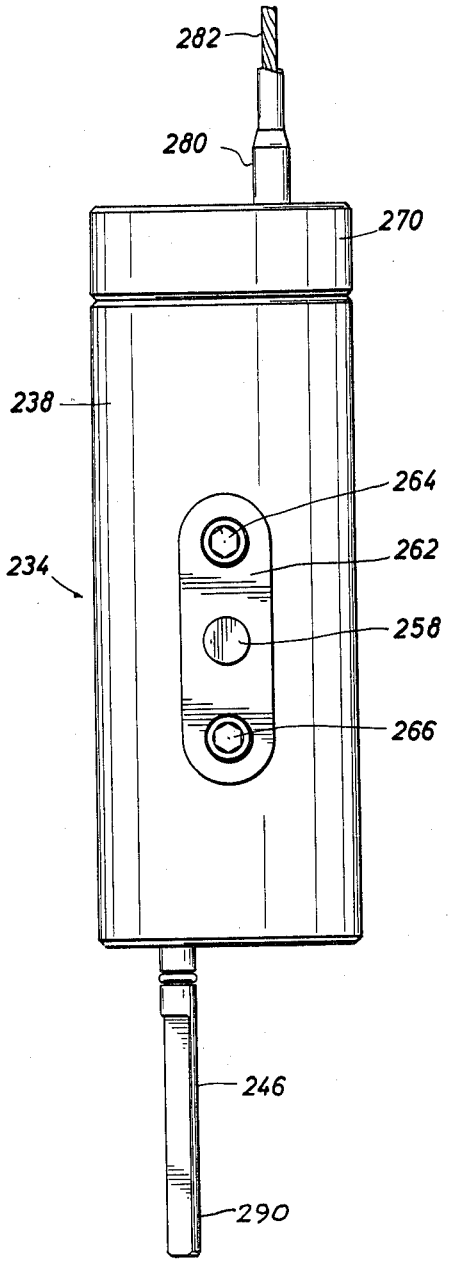

FIG. 9 is an outside view of the mechanical actuator mechanism of FIG. 7.

Figure 10:
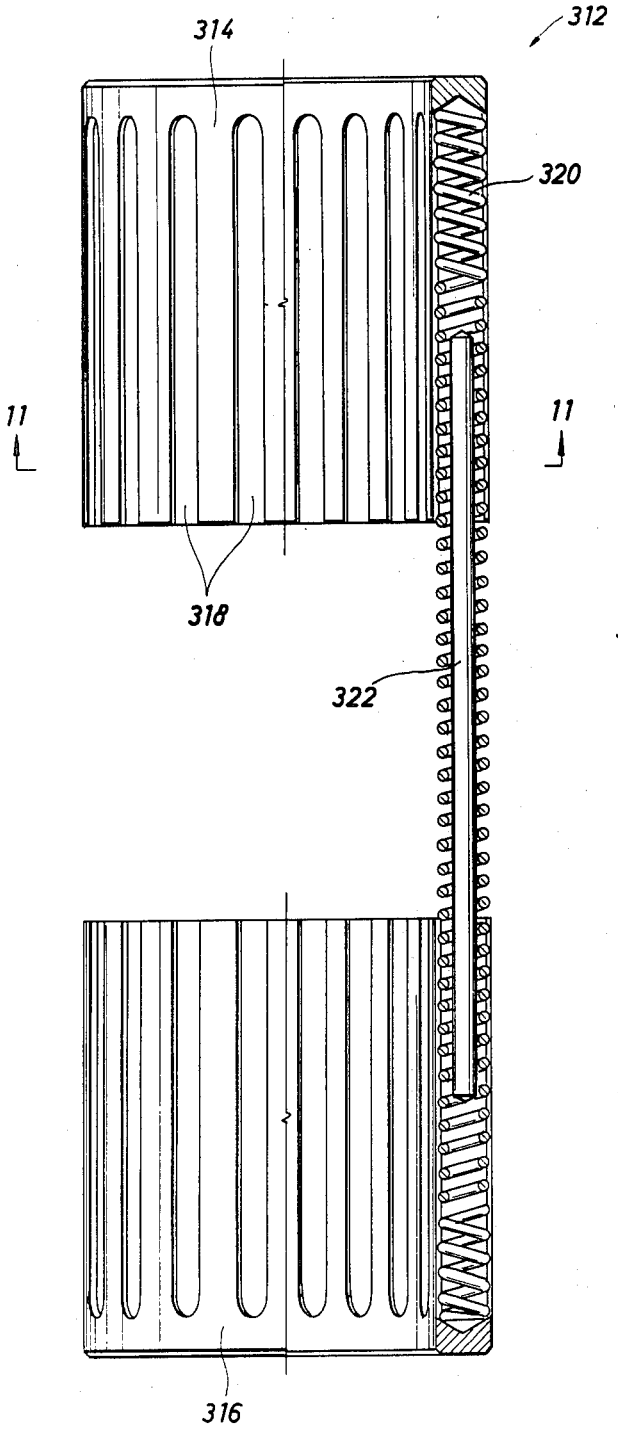

FIG. 10 is a partial sectional view of a multiple spring type spring capsule, representing a part of an alternative embodiment of the present invention.

Figure 11:
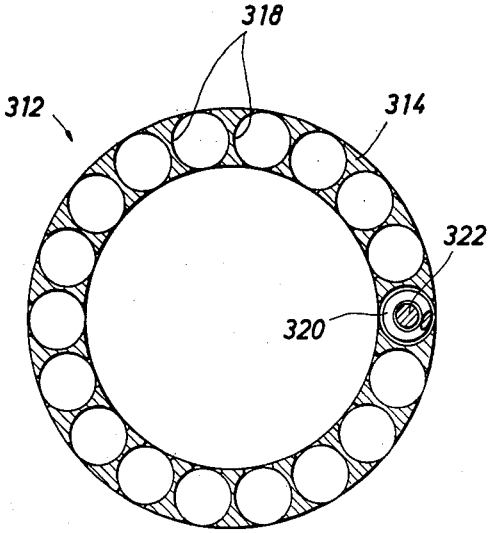

FIG. 11 is a transverse sectional view taken along line 11—11 of FIG. 10.

Figure 12:
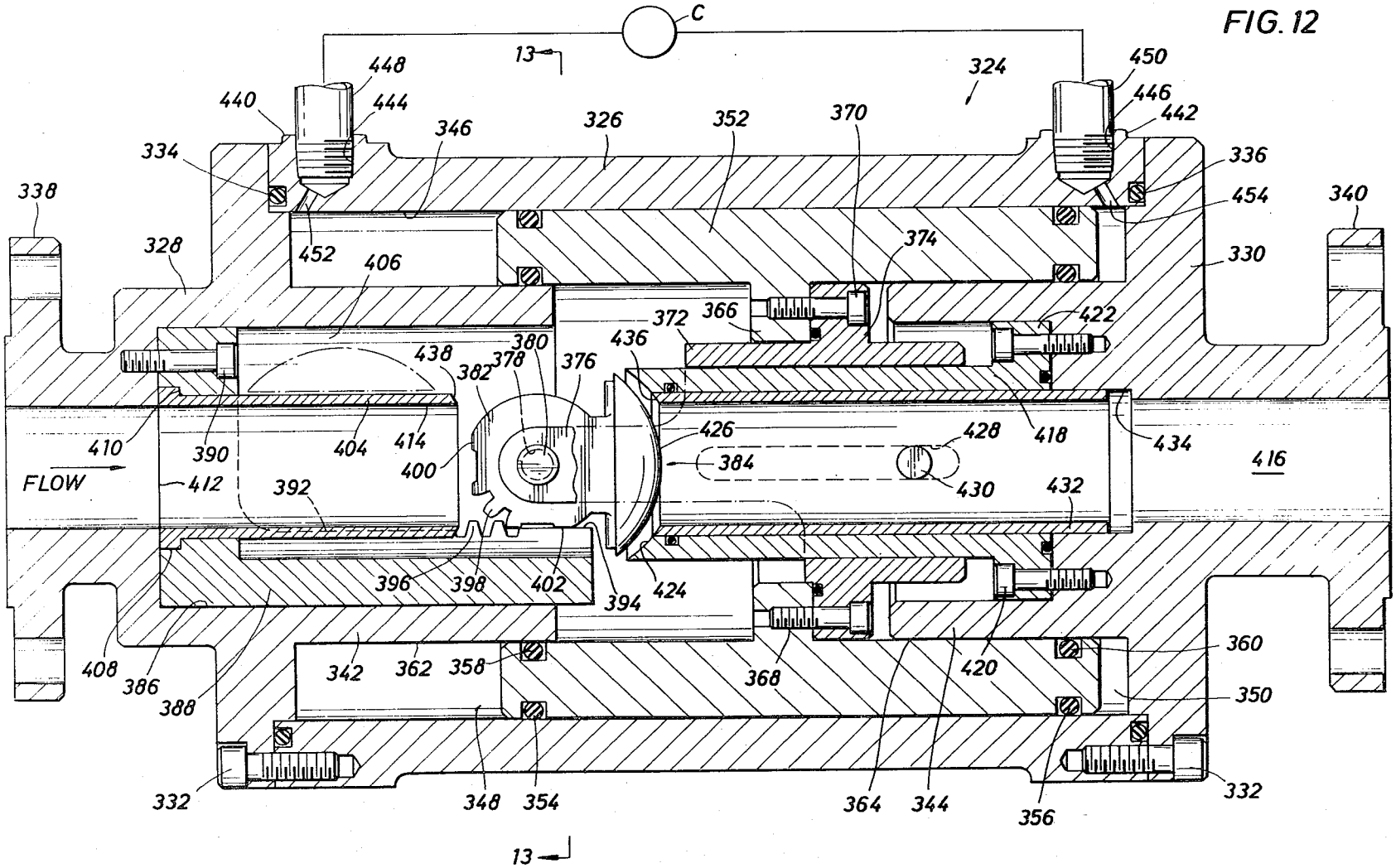

FIG. 12 is a sectional view of a packingless, hydraulically energized control valve constructed in accordance with the principles of this invention.

Figure 13:
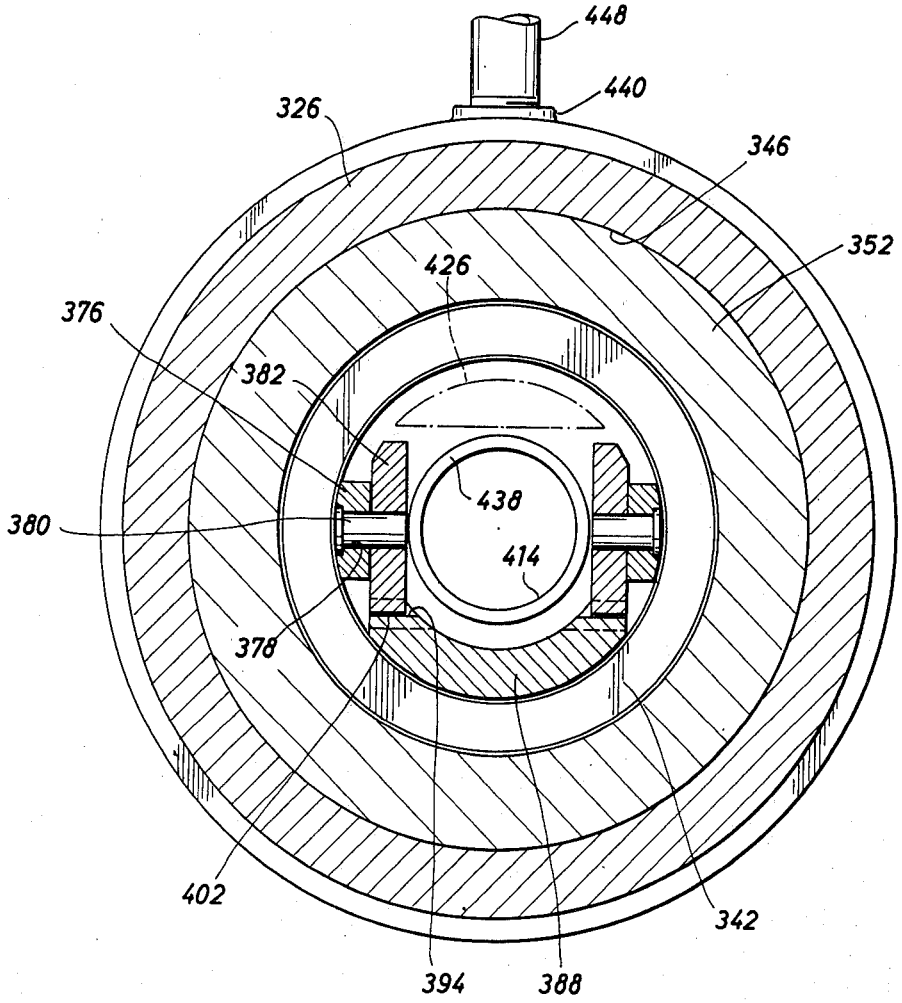

FIG. 13 is a transverse sectional view taken along line 13—13 of FIG. 12.

DETAILED DESCRIPTION OF PREFERRED EMBODIMENTS

Referring now to the drawings and first to FIG. 1, a down hole check valve installation is illustrated pictorially and partially in section. Within the earth formation 10, a well bore 12 is formed which bore is lined with a casing 14 that trasverses the formation being produced. A string of production tubing 16 extends downwardly through the casing to the vicinity of the production formation and extends through a packer element 18. The lower portion of the production tubing is open to the casing in typical manner and the casing is perforated at the production zone in order to allow production fluid, including gas, oil and other fluid, to enter the casing and thus enter the production tubing. The packer element 18 seals off the production interval from the well casing thereabove.

Down hole safety valves are typically installed above a packer element in the manner illustrated in FIG. 1, especially where wire line installation is desired. Such wire line installation typicaly incorporates a landing nipple 20 that is connected into the tubing string 16 by means of collars 22 and 24. The down hole safety valve, illustrated generally at 26 and constructed in accordance with this invention, is secured to the lower extremity of a wire line setting and retrieving mandrel 28 that is capable of being seated and locked with respect to the landing nipple by means of locator keys 30 and locking dogs 32 that are provided on the mandrel and are received within appropriate grooves within the landing nipple 20. The upper portion of the mandrel is typically provided with a wire line running and receiving neck.

Referring now to FIG. 2A of the drawings, the safety valve mechanism of the present invention is shown to include a connection and support body 34 having an internally threaded bore 36 formed at the upper extremity thereof for threaded connection to a wire line locking mandrel such as illustrated in FIG. 1. The connection and support body is formed to define an internally threaded portion 38 that receives the externally threaded portion 40 of a packing retainer and body support sub 42. A sleeve element 44 is positioned about a reduced diameter portion 46 of the sub 42 and is secured in fixed relation with the sub by means of a circular weld 48. An elongated groove in the sub 42, the sleeve element 44 or both defines an elongated channel or passage 50 through which hydraulic fluid may flow in the manner described hereinbelow. A packing assembly illustrated generally at 52 is positioned about the sleeve element 44 and functions to establish a sealed relationship with the wire line mandrel 28. Annular sealing element 54 establishes a seal to prevent leakage at the threaded connection between the connection support body 34 and the sub 42. A circular weld 56 secures the upper portion of sleeve 44 to the sub 42.

The sub 42 is formed to define an internally threaded increased diameter portion 58 within which is threadedly received an externally threaded portion 60 of an inner tubular housing portion 62. The outer housing structure of the safety valve mechanism 26 is formed by an elongated tubular housing element 64 having an internally threaded portion 66 at the upper extremity thereof that establishes threaded engagement with an externally threaded portion 68 of the packing retainer and body support sub 42. An annular sealing element 70 is supported within an annular groove formed within the outer tubular body element 64 and establishes fluid tight sealing engagement between the outer tubular body element and the lower portion of the sub 42.

The inner tubular housing portion 62 is sealed with respect to the sub 42 by means of an annular sealing element 72 supported within an annular groove defined within sub 42. The inner tubular housing portion 62 cooperates with the lower structure of the sub 42 to define an annular piston chamber 74 within which is received a generally cylindrical piston element 76 that is sealed with respect to the sub 42 by means of an annular sealing element 78 and sealed with respect to the inner tubular housing portion 62 by means of an annular sealing element 80. Hydraulic fluid may be introduced into the piston chamber 74 by way of the fluid supply passage 50 that is in turn connected in any suitable manner to a source of pressurized and controlled hydraulic fluid, not shown. The sub element 42 may be drilled to form an elongated fluid supply passage segment 82 that communicates with an annulus 84. The sub may also be formed to define a connector opening 86 in communication with the annulus 84 and a hydraulic fluid supply connection 88 may establish connection of a supply conduit 90 between the source of hydraulic fluid and the safety valve mechanism. To eliminate any projections from the exterior of the valve mechanism, hydraulic fluid supply may be accomplished by a fluid supply system essentially as illustrated in FIGS. 6A and 6B.

The piston element 76 is formed to define an annular abutment flange 92 and defines a lower externally threaded portion 94 receiving the upper internally threaded portion 96 of a valve actuator sleeve 98. A sealed relationship is established between the valve actuator sleeve 98 and the piston 76 by means of an annular sealing element 100 retained within an annular groove formed in the piston element 76. As the piston element 76 is formed downwardly under the influence of hydraulic pressure within the piston chamber 74, the valve actuator sleeve element 98 is also moved downwardly by virtue of its threaded connection with the piston element. It is desirable to provide a mechanism for imparting upward movement to the piston element to thus return the valve actuator sleeve 98 to its upper position. One suitable means for accomplishing return of the piston and the valve actuating sleeve may be conveniently accomplished in the manner illustrated in FIG. 2 by a compression spring 102 that is located within an annular spring chamber 104 defined between the valve actuator sleeve 98 and the inner tubular housing portion 62. A valve seat and guide sub 106 is formed to define an upper internally threaded portion 108 that receives the lower externally threaded portion 110 of the inner tubular housing portion 62. At the upper portion of the valve seat and guide sub 106 is defined an annular flange structure 112 defining a thrust shoulder 114 that is engaged by the lower extremity of the compression spring 102. The lower extremity of the piston element 76 defines an upper annular thrust shoulder 116 positioned for engagement by the upper extremity of the compression spring. As the piston element and valve actuator sleeve are moved downwardly under the influence of hydraulic fluid pressure, the compression spring 102 is compressed and thus stores mechanical energy sufficient to force the piston element 76 and the valve actuator sleeve 98 upwardly when hydraulic fluid pressure within the chamber 74 is relieved.

With regard now to FIGS. 2, 3 and 4, the valve actuator sleeve 98 is bifurcated at its lower extremity defining a pair of opposed support arms 118 and 120 defining pivot apertures 122 and 124 that receive valve pivot elements 126 and 128, respectively. A valve element generally illustrated at 130 is also constructed of bifurcated configuration defining a pair of opposed support elements 132 and 134 that are formed to define pivot apertures 136 and 138, respectively. The central portion of the valve element 130 defines a convex sealing surface 140 that may be of partially spherical configuration and is adapted for seating engagement with an annular seat surface 142 defined at the lower extremity of the valve seat and guide sub 106. The seat surface 142 may also be of partially spherical configuration, if desired.

It is desirable that the valve element 130 have a certain degree of limited linear movement in respect to the valve seat 142 and that the valve element be capable of rotating 90° to a position where the valve element is clear of a straight through elongated flow passage that is defined by the internal cylindrical bores of the various internal components of the valve mechanism. This straight through cylindrical bore enables production fluid to flow with least resistance through the valve mechanism and further allows servicing tools to be run through the valve mechanism in the event down hole servicing is required below the level of the safety valve mechanism. 90° rotation of the valve mechanism may be conveniently accomplished by means of a rack element 146 that is supported within the housing structure by means of an end cap element 148 that is threadedly received at the lower extremity of the outer tubular body element 64. The rack element is formed of partially cylindrical configuration, as illustrated in FIG. 4, and defines opposed sets of rack gear teeth 150 and 152 that are engageable by opposed sets of pinion gear teeth 154 and 156 defined on the opposed valve support elements 132 and 134, respectively. As the valve actuator sleeve 98 moves downwardly, during a certain portion of such downward movement the pinion gear teeth of the valve element will engage the teeth of the rack element 146 and will cause 90° rotation of the valve element from the position illustrated in FIGS. 2 and 5B to the position illustrated in FIG. 5C.

It is a feature of this invention that the valve element 130 be capable of moving linearly into and away from contact with the annular seat surface 142. This is conveniently accomplished in the manner shown in FIGS. 2B, 5A and 5B. With the valve element 130 in or near the closed position as shown in FIGS. 5A and 5B, segmented coplanar valve guide surfaces 148 and 150 are oriented in substantially parallel relation with the axis of the flow passage extending through the valve mechanism. Guide surfaces 150 and 152 are positioned for guiding engagement with opposed substantially planar surfaces 150 and 152 defined by the rack element 146. Surfaces 150 and 152 are also oriented in substantially parallel relation with the axis of the flow passage extending through the valve mechanism. With the valve element seated as shown in FIG. 5A, both of the guide surfaces 150 and 152 are disposed in guiding engagement with surfaces 162 of the rack element 146. In the position shown in FIG. 5A, the pinion gear tooth 164 is out of contact with the first one of the rack gear teeth 166. Contact between teeth 164 and 166 will be made only when the valve element has moved from the position shown in FIG. 5A to the position shown in FIG. 2B. After the valve actuator sleeve has moved the valve element to the position shown in FIG. 2B, continued movement of the valve actuator sleeve in a downward direction, through interengagement between the pinion gear teeth and rack gear teeth, causes 90° rotation of the valve element from the position shown in FIGS. 2B and 5B to the position shown in FIG. 5C.

The lower portion of the valve mechanism is designed to form a valve chamber 168 having a lower portion 170 thereof separated from the flowing fluid medium by means of a tubular partition 172. Between the tubular partition 172 and the outer tubular body portion of the valve mechanism, the lower portion of the valve chamber 168 defines a protective receptacle within which the arcuately curved head portion 139 of the valve element 130 is capable of being protectively located. After the valve element has been moved to the 90° rotated position illustrated in FIG. 5C, it is again appropriate to impart linear movement to the valve element to position the head portion 139 and the support elements 132 and 134 of the valve element within the protective enclosure. This feature is accomplished, as illustrated in FIGS. 5C and 5D. As shown in FIG. 5C, substantially planar elongated surfaces 174 are defined by the rack element 146, being disposed in substantially coplanar relation with opposed elongated surfaces 162. The opposed support elements 132 and 134 are formed to define substantially coplanar guide surfaces 176 and 178 that, in the position shown in FIG. 5C, are disposed in substantially parallel relation with the longitudinal axis of the valve flow passage. Guide surfaces 176 and 178 are capable of being positioned in sliding engagement with the elongated surfaces 174, thereby functioning to maintain the valve elements 132 and 134 in the position shown in FIG. 5C as it is moved linearly to the position illustrated in FIG. 5D.

As the valve element is moved in the opposite direction by the return spring 102 which imparts upward movement to the valve actuator sleeve 98, pinion gear tooth 180 will engage rack gear teeth 182 and will initiate rotation of the valve element from the position illustrated in FIG. 5C to the position illustrated in FIG. 5B as the valve element is moved upwardly by the valve actuator sleeve 98 under influence of the compression spring 102. After the valve element has been rotated to the position shown in FIG. 5B, continued upward movement of the valve actuator sleeve 98 will impart upward linear movement to the valve element 130 causing the sealing surface 140 of the head portion 139 of the valve element to move into direct sealing engagement with the annular sealing surface 142 of the valve seat and guide sub 106.

It is considered desirable to isolate the protective receptacle 170 from the flowing production fluid to prevent the valve element from being fouled or eroded by the production fluid. It is well known that oil and gas that is produced typically contains a certain amount of sand or other particulate that is eroded from the formation. Where safety valve elements are subjected to flowing production fluid, it is expected that wear may occur as sand and other particulate flows through the valve mechanism along with flowing production fluid. In accordance with the present invention, a pair of opposed pin elements 176 and 178 extend through apertures 181 and 182 formed in the valve actuator sleeve 98. Pins 176 and 178 extend through elongated slots 184 and 186 defined in the valve seat and guide sub 106 with the inner extremities of each of the pins being received within apertures 188 and 190 defined in a masking tube 192. Pin elements 176 and 178 function to establish a mechanical interconnection between the valve actuator sleeve 98 and the masking tube 192, causing the masking tube to be moved linearly along with the valve actuator sleeve 98. The cooperative relationship between the pin elements 176 and 178, the valve actuator sleeve 98 and the elongated slots 184 and 186 prevent the valve actuator sleeve from rotating within the valve housing and thereby confine the valve actuator sleeve solely to linear movement within limits defined by the length of the slots. The lower surfaces 194 and 196 of the slots define stop surfaces for engagement by the pins to thus limit downward travel of the valve actuator sleeve during full opening movement and retraction of the valve element into its protective receptacle 170.

The lower extremity of the masking tube 192 is formed to define a tapered annular seating surface 198 that is slightly spaced from the sealing surface 140 of the valve element when the valve is closed. The tapered seating surface 198 is primarily provided for seating engagement with an oppositely tapered annular seating surface 200 defined at the upper extremity of tubular element 172. As the valve element moves to the position illustrated in FIG. 5D, the masking tube 192 will move downwardly sufficiently to bring seating surfaces 198 and 200 into engagement. Although it is not intended that a positive seal be established when seating surfaces 198 and 200 are in engagement, it is intended that these surfaces fit sufficiently close that discernible fluid flow from the flow passage 144 into the valve chamber 168 and protective receptacle 170 will not occur. Thus, any particulate contained within the flowing production fluid will not enter the valve chamber and protective receptacle and the valve element will be protected against contamination or erosion by contaminants within the flowing production fluid.

It is desirable to provide a valve mechanism whereby formation pressure functions to assist the sealing ability of the valve and functions to assist in imparting closing movement to the valve mechanism. This feature is conveniently accomplished in the valve mechanism illustrated in FIGS. 1–4. The valve actuator sleeve 98 is provided with inner and outer annular sealing elements 202 and 204 that are retained, respectively, within inner and outer annular grooves defined in the valve actuator sleeve. The inner sealing element 202 establishes a seal between the valve actuator sleeve 98 and the valve seat and guide sub 106 while outer sealing element 204 establishes a seal between the valve actuator sleeve and the inner surface 206 of the outer tubular body element 64. Formation pressure entering the valve mechanism through opening 208, defined by the end cap 148, acts upon the exposed surface area defined by the lower extremity 210 of the cylindrical valve actuator sleeve 98, thus developing an upward force on the valve actuator sleeve that assists the return spring 102 in moving the valve mechanism to its closed position. Thus, closing movement of the valve mechanism occurs automatically under emergency conditions such as might occur through rupture of a flowline forces developed by the compression spring 102 and formation pressure acting upwardly on the valve actuator sleeve will very rapidly move the valve mechanism to its closed position. This movement is instantaneous and relatively little flow will occur through the valve mechanism during the automatic closing sequence of the valve mechanism.

The masking tube 192 is sealed with respect to the valve seat and guide sub 106 by an annular sealing element 212 that is retained within an annular internal groove defined within the sub 106. Sealing of the movable components of the valve mechanism is further enhanced by annular sealing elements 214 and 216 that are retained, respectively, within inner and outer annular grooves defined in the upper portion of the sub 106. Sealing element 214 establishes a seal between the valve seat and guide sub and the masking tube 192 while sealing element 216 establishes a seal between the sub 106 and the valve actuator sleeve 98. An O-ring type sealing element 218 is provided to establish a seal at the joint between the inner tubular housing portion 62 and the valve seat and guide sub 106.

OPERATION

With regard to the valve construction illustrated in FIGS. 1–4, opening and closing movements of the valve mechanism may best be understood with reference to FIGS. 5A–5D. With the valve mechanism in its closed position as illustrated in FIG. 5A, opening movement occurs as hydraulic pressure is introduced into the piston chamber, driving the valve actuator sleeve 98 downwardly, thus causing the valve element 130 to move downwardly in linear manner until the first teeth of the pinion gear portions of the valve element engage the first teeth of the rack element 146. As downward movement of the valve actuator sleeve 98 continues from this point, the rack and pinion gear teeth will interact causing pivotal movements of the valve element from the position illustrated in FIG. 5B to the position illustrated in FIG. 5C. The valve element is thus positioned for entry into its protective receptacle 170 defined by the annulus between the tubular body element 64 and the inner tubular portion 172. The masking tube, being interconnected with the valve actuator sleeve 98 by means of the connector pins 176 and 178, will move downwardly along with the valve actuator sleeve during opening movement of the valve mechanism. As shown in FIG. 5A, the masking tube 192 is fully retracted while the sealing surface of the valve element 130 is in sealing engagement with the annular seat surface 142. As the valve actuator sleeve 98 moves downwardly, as shown in FIG. 5B, the masking tube will also initiate its downward movement. Upon rotation of the valve element to the position illustrated in FIG. 5C, the masking tube 192 will have moved further downwardly toward the upwardly extending tubular element 172. At the full open position as shown in FIG. 5D with the valve element fully retracted within its protective receptacle 170, the masking tube 192 will have moved downwardly sufficiently to bring its seating surface 198 into engagement with the opposing seating surface 200 of the tubular element 172.

In the event the valve mechanism should become automatically closed responsive to sensing of a low pressure condition downstream and should it become desirable to reopen the valve mechanism, such can be conveniently accomplished simply by introducing hydraulic pressure into the piston chamber 74, thus driving piston element 76 and valve actuator sleeve 98 downwardly in the manner described above. In the event the hydraulic system should fail, thus releasing pressure within the piston chamber 74, the compression spring 102, together with the force induced by formation pressure, will urge the valve mechanism to its closed position. Should it become desirable to reopen the valve mechanism even though a hydraulic failure exists, it is desirable to provide a mechanical override system having the capability of opening the valve against the influence of spring and pressure induced forces. A mechanical override system capable of opening the valve may conveniently take the form illustrated in FIGS. 6A and 6B, each being partial views of a unitary down hole safety valve mechanism. The structure illustrated in FIG. 6A, except for the mechanical actuation mechanism, is essentially identical with respect to the structure set forth in FIGS. 2A and 2B, and therefore identical reference characters are utilized to indicate corresponding parts. As shown in FIG. 6A, a connector sub 220 is provided having an internally threaded portion 222 that is adapted to receive the externally threaded lower extremity of a conventional wire line locking mandrel such as illustrated in FIG. 1. The lower portion of the connector sub is internally threaded as shown at 224 and receives the upper externally threaded portion 226 of a body and actuator connector element 228 having an elongated internal tubing section 230 and defining an annular shoulder 232. A mechanical actuator section 234 is positioned about the elongated tubular section 230 of the body and actuator connector element and is retained in intimate immovable engagement with connector element 228 by virtue of being interposed between shoulder 232 of the connector element and annular shoulder 236 of the connector sub 220. The mechanical actuator section includes a generally cylindrical body 238 defining an internally cylindrical surface 240 that fits closely about the cylindrical tubular portion 230 of the body and actuator connector element. The cylindrical body 238 is formed to define a pair of internal, generally parallel bores 242 and 244, each receiving elongated rack pins 246 and 248, respectively, having rack teeth 250 and 252 formed respectively thereon. Rack pins 246 and 248 are movable within the respective bores.

Each of the elongated bores 242 and 244 intersects a centrally located pinion gear recess 254 within which is rotatably received a pinion gear 256 having a bearing shaft 258 extending therefrom. The bearing shaft is receivable within a bearing opening 260 defined in an elongated retainer plate 262. The pinion gear retainer plate is secured in assembly with the cylindrical body 238 by means of a pair of cap screws 264 and 266 as shown in FIG. 9. The teeth of the pinion gear are maintained in engaged relation with the teeth of each of the rack pins 246 and 248. This relationship causes the rack pins to move in opposed direction upon rotation of the pinion gear. Thus, upward movement of the rack and pin 248 induces the pinion gear 256 to cause downward movement of the rack pin 246.

At the upper portion of the mechanical actuator is provided a cable connector element 270 of the same external dimension as the cylindrical body 238. Cable connector 270 is formed to define a partial bore 274 being axially registered with bore 244 of the body 238. Partial bore 274 is interconnected with bore 244 by a cable opening 276 through which a bowden cable 282 extends. A bowden cable connector 280 is received within the internally threaded bore or opening 274 and secures bowden cable 282 in assembly with the cable connector element. The bowden cable is connected to the rack pin 248 in any suitable manner, thereby causing the rack pin to be moved upwardly responsive to upward movement of the bowden cable 282.

Referring now to FIG. 6B, the mechanical actuator 234 is simply placed over the elongated sleeve portion 230 of the body and actuator connector element 228. The rack pin 246, extending below the lower extremity of the cylindrical body 238, is received in closely fitting engagement within a bore 284 defined in the body and actuator connector element 228. A sealing element 286, such as an O-ring or the like, is received within an annular groove defined in the rack pin 246 and establishes sealing engagement between the rack pin and bore 284. The lower extremity of the rack pin 246 is cut away as shown at 288 to define an offset piston actuating portion 290 that is positioned in registry with the piston chamber 74. After limited downward movement, the lower extremity of the piston actuating portion 290 will contact the upper extremity of the piston element 76 and, upon continued downward movement of the rack pin 246, the piston actuating portion will drive the piston 76 downwardly. As the piston element is moved downwardly by the mechanical actuator mechanism with sufficient force to overcome the force of the compression spring 102 and the force developed by formation pressure acting upon the valve actuator sleeve, the valve element 130 will be caused to move to its open, protected position as illustrated in FIG. 5D.

For the purpose of providing pressurized hydraulic fluid for pressurization of the piston chamber 74, the body portion 238 of the mechanical actuator 234 will be formed to define an elongated slot 292 and the cable connector element 270 will be provided with a registering external slot 294. A hydraulic fluid supply conduit 296 is received within slots 292 and 294 and within a slot 298 defined in the connector sub 220. This conduit will extend upwardly through the well bore and within the production tubing as illustrated in FIG. 1 where a pressurized source of hydraulic fluid will be located and will be provided with such controls as is appropriate for achieving controlled operation of the safety valve mechanism. The body and actuator connector element 288 is formed to define an enlarged connector receptacle 300 communicating with a hydraulic fluid supply bore 302 that communicates with the annular piston chamber 74. An enlarged connector element 304 is received within the receptacle 300 and is restrained in position within the receptacle by the lower surface 306 of the mechanical actuator body 238 which bears against an annular shoulder 308 defined by the conduit connector element 304. Thus, upon assembly of the mechanical actuator mechanism, the hydraulic supply conduit is positively interconnected with the body and actuator connector element for the supply of pressurized hydraulic fluid to the piston chamber. An annular sealing element 310 is retained within an annular chamber to insure a positive seal between the connector element 304 and the body and actuator connector element 228. Thus, it is apparent that provision of the mechanical actuator mechanism 234 allows the piston element 76 to be operated either hydraulically or mechanically to the open position thereof. Closing movement in either case is controlled by the stored energy of the compression spring 102 and the force induced to the actuating sleeve 98 by formation pressure. The mechanical actuator mechanism provides a mechanical override backup system for achieving valve opening under circumstances where the hydraulic system may be rendered inoperative.

In view of the fact that the safety valve mechanism of the present invention is designed for insertion through the tubing string of a well, it is obvious that the maximum outside dimension of the valve mechanism is critical. The maximum outside dimension could, in some circumstances, require the compression spring 102 to be of restricted size and it may be difficult to provide a single helical compression spring capable of developing the desirable force for valve closing movement. As shown in FIGS. 10 and 11, a modified spring package may be provided wherein a plurality of compression springs are utilized to provide a designed closing force for the valve mechanism. The spring capsule, illustrated generally at 312, is dimensioned for insertion into the spring chamber 104 for replacement of the single compression spring 102. A pair of generally cylindrical spring receptacles 314 and 316 are provided, each being drilled or otherwise formed to define a plurality of elongated, slotted spring retainer receptacles 318. A plurality of compression springs 320 are provided having the extremities thereof disposed within the spring receptacles of respective ones of the spring capsule sections 314 and 316. In order to provide a more clear understanding of the present invention, the upper portion of the spring capsule illustrated in FIG. 10 is broken away showing only one of the compression springs 320 together with the relationship of the compression spring to the spring receptacle 318.

Within each of the compression springs is loosely provided an inner support rod 322 that is of sufficient length to bridge the space between spring retainer elements 314 and 316 at the widest separation thereof. The inner support rods provide against transverse bending of the compression springs, thereby allowing each of the compression springs to develop maximum resistance upon being compressed by downward movement of the piston and actuating sleeve. Obviously, the maximum force potential of the spring capsule will be achieved when compression springs are retained within each of the receptacles. The force resistance of the spring capsule may be modified by eliminating some of the compression springs, thereby promoting a valve design incorporating a spring package that can be calculated to provide designed force resistance. The receptacles move into abutment under maximum force and prevent over compression of the springs. Also, the fully collapsed spring capsule provides a mechanical stop function to limit movement of the valve actuating sleeve 98, thus preventing severe forces from acting on the pin elements 176 and 178.

Although the present invention has been discussed heretofore in its application particularly to its service as a safety valve in a down hole well environment, it is not intended in any manner whatever to restrict utilization of the present invention to such use. In the embodiment illustrated in FIG. 12, a valve mechanism incorporating the basic features of the present invention may be utilized as a controllable flowline valve which may be utilized in hazardous environments where valve stem leakage from typical valves cannot be tolerated. The flowline valve which is illustrated generally at 324 incorporates a generally cylindrical body portion 326 having end sections 328 and 330 secured thereto by means of bolts or cap screws 332 or by any other suitable form of connection. The end closure elements 328 and 330 are sealed with respect to the cylindrical body 326 by means of annular sealing elements 334 and 336 that are retained within end grooves formed in the body 326. A pair of connector flanges 338 and 340 are formed integrally with the end closure elements 328 and 330 and provide means for establishing connection between the valve mechanism and a flanged flowline, not shown. Obviously, any other suitable means for connecting the valve mechanism to a flowline may be incorporated within the spirit and scope of the present invention.

Each of the end closure elements defines respective inwardly projecting cylindrical hubs 342 and 344 which cooperate with inner cylindrical surface 346 of the body 326 to define a pair of spaced piston chambers 348 and 350. An elongated piston element 352 is provided having each extremity thereof received within respective one of the piston chambers 348 and 350. A piston element is sealed with respect to the valve structure by outer sealing elements 354 and 356 that engage the internal cylindrical surface 346 of the body and by inner annular sealing elements 358 and 360 that engage the cylindrical surfaces 362 and 364 of the inwardly extending hubs.

The piston element is formed to define an internal support flange 366 that defines a plurality of threaded holes 368 receiving bolts or cap screws 370 for the purpose of securing a valve support body 372 in supported relation with the internal flange 366. The bolts or cap screws 370 extend through apertures in a connection flange 374 of the valve support body and positively secure the flange and the valve support body in immovable engagement with the internal support flange 366.

The valve support body 372 is of generally cylindrical cross-sectional configuration and includes a bifurcated extremity defining a pair of support arms 376 each having pivot apertures 378 formed therein and adapted to receive pivot elements 380 to establish pivotal engagement between the support arms 376 and a pair of pivotal support elements 382 of a valve element illustrated generally at 384.

Hub member 342 establishes an internal receptacle 386 adapted to receive a rack body 388 that is secured in assembly with the end closure element 328 by a plurality of bolts or cap screws 390. The lower portion of the rack element 388 is formed to define opposed pairs of planar guide surfaces 392 and 394 with rack teeth 396 being defined between the planar guide surfaces. Each of the pivotal portions 382 of the valve element 384 are formed to define pinion gear teeth 398 interposed between planar guide surfaces 400 and 402, the guide surfaces 400 and 402 being disposed in normal relation to each other in order to facilitate 90° rotation of the valve element. As the valve element is moved longitudinally along with the valve support body 372 and piston element 352, the valve element will have an initial increment of linear movement followed by 90° rotational movement resulting from interaction of the pinion gear teeth with the rack teeth and subsequently followed by another increment of linear movement as the valve element is retracted to a protected position. Valve actuation is substantially identical as compared to the down hole safety valve structure described above in connection with FIGS. 1–4.

For the purpose of protecting the valve element from erosion and to define a through conduit type flow path, an elongated tubular element 404 is positioned within the valve and cooperates with the annular hub 342 to define a protected receptacle 406 within which the sealing portion of the valve element may be retracted in essentially the same manner as discussed above in connection with tubular element 172 of FIG. 2. The elongated tubular element 404 is provided with an annular flange 408 at one extremity thereof which is adapted to be received within a flange recess 410 defined at one extremity of the rack body 388. The flange 408 is retained by the rack body against the end surface 412 to maintain the tubular element 404 in proper position within the valve chamber so as to align the internal flow passage 414 thereof with the straight through flow passage 416 of the valve mechanism.

At the right hand portion of the valve mechanism shown in FIG. 12, an elongated tubular element 418 is provided which is secured to the end closure element 330 by means of bolts or cap screws 420 that extend through apertures formed in an annular connection flange 422. The tubular element 418 is formed at the free extremity thereof to define an annular seat surface 424 that is positioned for sealing engagement by a sealing surface 426 formed on the valve member 384. Sealing surface 426 and seat member 424 may be of partially spherical configuration if desired, or may take any other convenient form for establishment of proper sealing engagement. The tubular element 418 is also formed to define a pair of elongated opposed slots 428 and a pair of connector pins 430 extend through the slots 428 and establish connection between the movable valve support body and a masking tube 432 that is movably received within a cylindrical recess 434 defined cooperatively by end closure element 330 and tubular element 418. As the valve support body 372 is moved linearly by the piston element 352, the masking tube 432 will move linearly along with the valve support body by virtue of its pinned connection therewith. The opposed slots and connector pins may be of similar configuration and operation as those illustrated and described in conjunction with FIGS. 2B and 3. One extremity of the masking tube 432 is formed to define a seat surface 436 which is capable of establishing seating engagement with a mating seat surface 438 defined by the free extremity of the tubular element 404. Upon full rotation and retraction of the valve element 384 into the protective receptacle 406, the masking tube 432 will have moved linearly sufficiently to bring the seating surface 436 into engagement with seating surface 438 of tubular element 404. Fluid will be allowed to flow through the flow passage 416 of the valve and any erosive substance contained within the flowing fluid will not erode or file the valve element.

For the purpose of imparting operative movement to the piston element 352, the valve body 326 is formed to define a pair of bosses 440 and 442, each being formed to define internally threaded openings 444 and 446, respectively. Fluid supply conduits 448 and 450 may be interconnected within the threaded openings 444 and 446 for the purpose of supplying pressurized hydraulic fluid to piston chambers 348 and 350 as required for operation of the valve. Conduits 448 and 450 are interconnected wtih a control system schematically illustrated at 5C, which control system may take any convenient form for selectively and controllably introducing hydraulic fluid into piston chambers 348 and 350 or receiving hydraulic fluid from these chambers. The internally threaded openings 444 and 446 are communicated with piston chambers 348 and 350 by means of fluid ports 452 and 454.

From the standpoint of operation, it should be borne in mind that the valve mechanism of FIG. 12 is typically a unidirectional valve with flow being shown in the direction of the flow arrow located at the left hand portion of the flow passage 416. The valve can function, however, with flow in the opposite direction.

In view of the foregoing, it is readily apparent that I have provided a valve mechanism that may be efficiently utilized either in a down hole well environment as a safety valve or storm choke or as a packingless hydraulically or pneumatically controllable valve for flowlines. In each case, a valve mechanism is employed incorporating a valve element that may be retracted to a protected position where it may not be contacted by erosive materials contained within the flowing fluid handled by the valve mechanism. In the down hole well environment, the valve mechanism may function as a safety valve or storm choke incorporating combined forces of stored energy from a compression spring and force developed by formation pressure to achieve automatic closure of the valve in the event a hazardous predetermined condition occurs.

As a flowline control valve, a hydraulic actuating system may be provided for inducing opening and closing controlling to the valve mechanism and it will not be possible for the valve mechanism to leak fluid as might otherwise occur upon failure of a conventional operating stem packing. This feature promotes a valve mechanism that satisfactorily functions in hazardous environments and may be efficiently controlled at a substantial distance from the site of the valve itself.

I have provided a spring package that may be substituted for a single compression spring for a valve operating in a down hole well environment. The maximum force developed by the spring package may be selectively adjusted simply by selective deletion of springs, thereby promoting automatic valve control responsive to designed pressure and well conditions.

It is clearly evident that I have provided a valve mechanism which incorporates all of the features and objects hereinabove set forth together with other features and objects which are inherent in the construction of the valve mechanism itself. Although the present invention has been described in its particular application to down hole safety valves and flowline valves, it is not intended to limit the invention in any manner whatever.

What is claimed is:

1. A compression spring capsule comprising:

a pair of generally cylindrical tubular spring retainer bodies, each being formed to define a plurality of elongated cylindrical blind spring retainer recesses being oriented in generally parallel relation and substantially parallel to the elongated axis of said spring retainer bodies;

a plurality of helical compression springs being provided having the extremities thereof positioned within said spring retainer recesses in each of said pair of spring retainer bodies and spacing said bodies a first distance from each other when in an uncompressed state; and inner support rods being loosely positioned within each of said plurality of compression springs with the extremities thereof receivable within said opposed spring retainer recesses, the length of each of said inner support rods exceeding said first distance of said spring retainer bodies and being less than the combined length of said spring retainer recesses when said spring retainer bodies are disposed in abutment.

2. A compression spring capsule as recited in claim 1, wherein:

each of said spring retainer bodies is of tubular form defining cylindrical internal and external surface configuration; and each of said spring retainer recesses is of generally cylindrical configuration.

3. A compression spring capsule as recited in claim 2, wherein:

each of said spring retainer recesses is formed to intersect the inner and outer generally cylindrical surfaces of said spring retainer bodies, thus defining a plurality of elongated generally parallel inner and outer slots exposing said compression springs along the length thereof.

* * * * *